United States Patent [19]

Blumenthal et al.

[11] 4,140,430

[45] Feb. 20, 1979

[54] WALKING MINE ROOF SUPPORT

[75] Inventors: Günter Blumenthal, Westerholt; Hans-Ferdinand Bemmerl, Herne, both of Fed. Rep. of Germany

[73] Assignee: Bochumer Eisenhütte Heintzmann GmbH & Co, Bochum, Fed. Rep. of Germany

[21] Appl. No.: 898,315

[22] Filed: Apr. 19, 1978

[30] Foreign Application Priority Data

May 5, 1977 [DE] Fed. Rep. of Germany ..... 2720179

[51] Int. Cl.[2] ..... E21D 15/44

[52] U.S. Cl. ..... 405/291

[58] Field of Search ..... 61/45 D; 299/31-33; 91/170 MP; 248/357

[56] References Cited

U.S. PATENT DOCUMENTS

| | | | |
|---|---|---|---|
| 3,434,292 | 3/1969 | Heyer | 61/45 D |
| 3,482,878 | 12/1969 | Floter | 61/45 D X |
| 3,490,243 | 1/1970 | Groetschel | 61/45 D |
| 4,027,489 | 1/1977 | Walker et al. | 61/45 D |

FOREIGN PATENT DOCUMENTS

| | | | |
|---|---|---|---|
| 1358541 | 7/1974 | United Kingdom | 61/45 D |

*Primary Examiner*—Dennis L. Taylor
*Attorney, Agent, or Firm*—Michael J. Striker

[57] ABSTRACT

A walking mine roof support has a roof engaging cap element, two supporting units each including a floor engaging plate member and a prop extending between a respective one of the plate members and the roof supporting cap element so as to support the latter, which floor engaging plate members are displaceable in a first direction toward a mine face and are spaced from one another in a second direction transverse to the first direction, and displacing elements for displacing the floor engaging plate members in the first direction and including two guiding elements spaced from one another in the second direction and two hydraulic cylinder-piston units operative independently of one another. Each of the hydraulic cylinder-piston units connects one of the guiding elements with a respective one of the floor engaging plate members so as to displace the latter relative to but independently of one another in the first direction.

10 Claims, 4 Drawing Figures

WALKING MINE ROOF SUPPORT

BACKGROUND OF THE INVENTION

The present invention relates to a shield-shaped or frame-shaped walking mine roof support. More particularly, it relates to a mine support which has a roof engaging cap element, two supporting units each including a floor engaging plate member and a prop extending between a respective one of the plate members and the roof supporting cap element so as to support the latter, and displacing means for displacing the floor engaging plate members.

Shield-shaped roof supports and supporting frames with one piece roof engaging cap element and two floor engaging plate members movable independently of one another, particularly in a vertical direction, have been proposed in the art. The roof engaging cap elements have in many cases large surfaces and their width corresponds to the length of the individual segments of a conveyor for transporting removed material, which conveyor can form an abutment element for the supports. The length of the individual segments usually corresponds to 1.50 meters. A guiding element is located between the floor engaging plate members. A mine face end portion of the guiding element is articulately connected with the conveyor, whereas its other end portion is connected with the backwardly directed end section of a (usually hydraulically operated) cylinder-piston unit. The front end section of the cylinder-piston unit is fixed to a bridge, which is connected with the mine face end sections of the floor engaging plate members and thereby transversely overlies the guiding element. Preferably, the piston rod of the cylinder-piston unit is connected with the rearward end section of the guiding element, whereas the cylinder of the cylinder-piston unit is connected with the bridge. In this case, the large surface of the piston can be used for simultaneous displacement of both floor engaging plate members, i.e., for displacement of the shield-shaped supports or the supporting frames, and the small annular surface in the piston rod space can be used for displacement of the conveyor. The respective supporting units to be moved, on the one hand, and the conveyor together with the supporting unit fixed thereto, on the other hand, thus each alternately form an abutment for the other, in the case of advancement or pulling of the respective elements.

This arrangement and manner of operation has the advantage that during the advancement of the roof support, due to the large surface of the roof supporting cap element and the supporting force which is necessarily reduced during such advancement when the surface is disengaged, a relatively large roof area is temporarily not supported or supported only with such a supporting force which just permits a displacement of the roof support. The locally reduced support of the rock, especially in the case of very unstable roof rocks, makes it impossible to categorically prevent breaking or flowing of the roof rock under these circumstances, It has been further proposed to combine two shield-shaped supports or two supporting frames into one supporting unit and to provide displacing means therebetween. Such a support unit can walk and perform forward and backward movements fully independent of the mine-face removal operation, i.e., that is of the conveyor advancing motion. This independence of the supporting unit from the conveyor is of advantage, e.g., when kinks occur during the advancement when and due to this, the position of a given supporting unit cannot, or only by special labor-intensive step, be accommodated to the (now curved or kinked) shape of the articulated conveyor. However, in this case special conveyor-moving devices are necessary, which increase the apparatus expenditures for the arrangement. Furthermore, such support units, whether constructed as a shield-shaped support or a supporting frame, have the same large-surface roof engaging cap as the first-mentioned arrangement, wherein the supporting units are articulately connected with the conveyor through the guiding element. Since the width of a support or a supporting frame is in practice usually equal to about 1.50 meter in order to correspond to the length of the segments of the conveyor, this means that even in self-advancing shield-shaped supports or supporting frames large roof areas are sometimes not or not sufficiently supported during displacement of these units. Layers of rock which tends to break or to flow therefore require the use of special methods which naturally require higher expenditures of material and larger numbers of miners.

SUMMARY OF THE INVENTION

Accordingly, it is an object of the present invention to provide a walking mine roof support which avoids the disadvantages of the prior art.

More particularly, it is an object of the present invention to provide a walking mine roof support which supports a larger mine roof surface during advancement thereof as compared with the known mine roof supports.

In keeping with these objects, and with others which will become apparent hereinafter, one feature of the present invention resides, briefly stated, in a walking mine roof support in which an engaging plate member of each of two supporting units is connected with a guiding element through a hydraulic cylinder-piston unit, and the two hydraulic cylinder-piston units operate independently of one another. In this case each floor engaging plate member of a respective one of the supporting units is connected at both sides of the intermediate guiding elements with the latter through its own cylinder-piston unit, and both cylinder-piston units are operative independently of one another. Therefore, each of the supports can be displaced fully independently of the fact whether the guiding element is or is not connected with the abutment which is offset in the direction toward the mine face, for instance with a conveyor. The separate connection of both supporting units with the intermediate guiding elements and the thus-attained independence permits the total width of the shield-shaped or framed supporting unit in accordance with the invention, including two separate supports and displacement means located therebetween, to be retained such or so small as the width of a shield-shaped support or a supporting frame of the conventional constructions.

As far as the rock conditions permit, the support unit can be actuated by corresponding operation of the cylinder-piston units in the same manner as the conventional supports. This means that the complete support unit is connected with the conveyor so that the cylinder-piston units can operate simultaneously and in the same direction, and the guiding elements are connected with the conveyor. The conveyor and the support unit can thereby be alternately displaced. On the other hand, it is now also possible, however, depending upon the rock conditions, to move each individual support unit at both sides of the intermediate guiding elements independently of the other unit, without requiring disconnecting of the guiding element from the conveyor. Therefore, only half of the roof area, namely that portion above the support unit which is being moved, is temporarily unsupported. It is further possible to move the mine roof support in accordance with the invention independently of the conveyor in the sense of a self-displaceable unit, in which case the guiding element will be disconnected from the conveyor. The mine roof support in accordance with the invention therefore combines, on the one hand, the advantages of the known constructions, whether they are self-displaceable or connected with the conveyor, and, on the other hand, eliminates the disadvantages of the known constructions. It is thus usable in a more flexible manner and therefore can be accommodated much better to the given underground conditions which, as is known, may change more or less frequently during operation.

Another advantageous feature of the present invention is that each of the floor engaging plate members has a mounting or anchoring plate interchangeably mounted thereon, and each of the hydraulic cylinder-piston units has a mine face end section connected to one of these mounting plates, whereas each of the guiding elements extends through a respective one of the mounting plates and is movable relative to the latter in an axial direction and in a vertical direction. The interchangeability of the mounting plates facilitates the maintenance in mines and reduces sometimes necessary repair time. The vertically arranged mounting plates extend transversely to the longitudinal direction of the guiding elements. Adjacent sections of the mounting plates have rearwardly facing formations which are connected with forked formations of the hydraulic cylinder-piston units by means of vertical pivot bolts.

It is advantageous if, in the mine roof support in accordance with this embodiment, the cylinder of the cylinder-piston unit faces towards the mine face, whereas the piston rod faces rearwardly, i.e., away from the mine face, in order to be able to utilize the larger piston surface for displacement of the supporting units and the annular piston surface for shifting of the conveyor. The cylinder-piston units are preferably located above the guiding elements which can be formed, for example, by two parallel rods located adjacent to one another. The guiding elements can be connected at the mine face end with an L-shaped extension which due to its trough-shaped construction, facilitates advancement of the miner in mines with thin seams and makes it possible to control the mining machine or the mine roof support. The longer arm of the extension closely accommodates itself to the mine floor, whereas the rearward end section thereof is formed by the mounting plate. The short vertical mine face arm of the trought-shaped extension serves for at least indirectly connecting the extension to the conveyor.

The rearward end sections of the rods of the guiding elements are received in two tubular members which are rigidly connected with one another by e.g. two vertically spaced cross-bracing elements. Three vertical frame members are located above the tubular members, and a single bolt extends through these vertical members. The heads of the piston rods of both cylinder-piston units are vertically turnably engaged on the transverse bolt. The adjacent regions of the mounting plates have vertically elongated holes and both guiding elements extend through these holes. The play of the guiding elements in the elongated holes is so dimensioned that they can vertically move by a distance which is about three times greater than the diameter of the guiding elements. The lateral play of the guiding elements in the elongated holes, on the other hand, is only sufficient to guarantee proper relative movement of the mounting plates and the guiding elements for conforming to the underground conditions.

In accordance with a further advantageous feature of the present invention, the mine face end sections of the floor engaging plate members are tubular and have a recess in which a tubular section of a respective mounting plate is insertable and connectable therewith by means of one or more bolts. The lower sides of the mounting plates lie on the upper surfaces of the floor engaging plate members and have the aforementioned tubular sections welded to their mine face end portions. The length of these sections corresponds substantially to the recesses formed in the front end of the floor engaging plate members. The connection of the tubular fron ends of the floor engaging plate members with the tubular sections of the mounting plates is performed from the side of the supporting units by means of bolts.

In accordance with the present invention the mounting plates serve not only for fixing the cylinder-piston units, but also for turnably fixing of the props at the lower ends thereof facing toward the floor engaging plate members. For this purpose, the mounting plates have recesses. Two braces which are bent at an angle of about 45° are inserted in the recesses of the mounting plates and connected by bolts. The opposite ends of the braces engage in consoles arranged on the upper surfaces of the floor engaging plate members and are also fixed by bolts. The bending points of the braces are located above lateral pivots of the props. The props are inserted in cup-shaped depressions of the floor engaging plate members and centered therein. Easy mounting or dismounting of the props is guaranteed by insertion or withdrawal of the bolts by which the braces are connected with the mounting plates or with the floor engaging plate members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
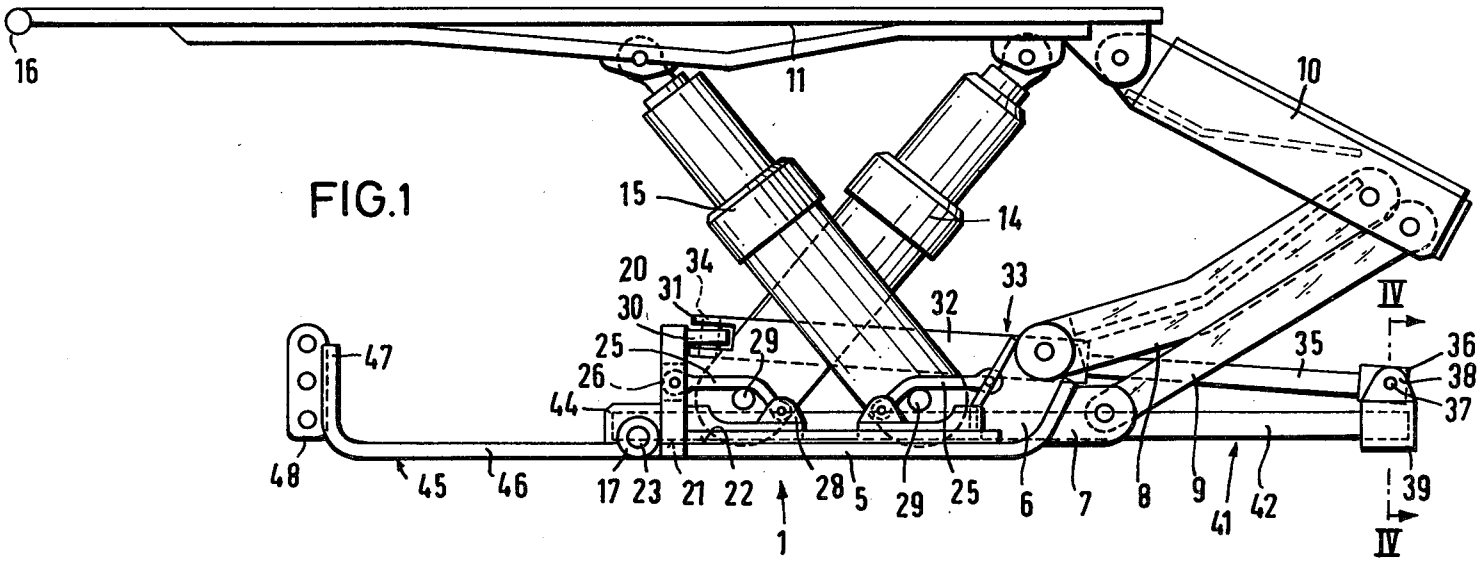
FIG. 1 is a side view of a shielf-shaped mine roof support in accordance with the present invention.
Figure 2:
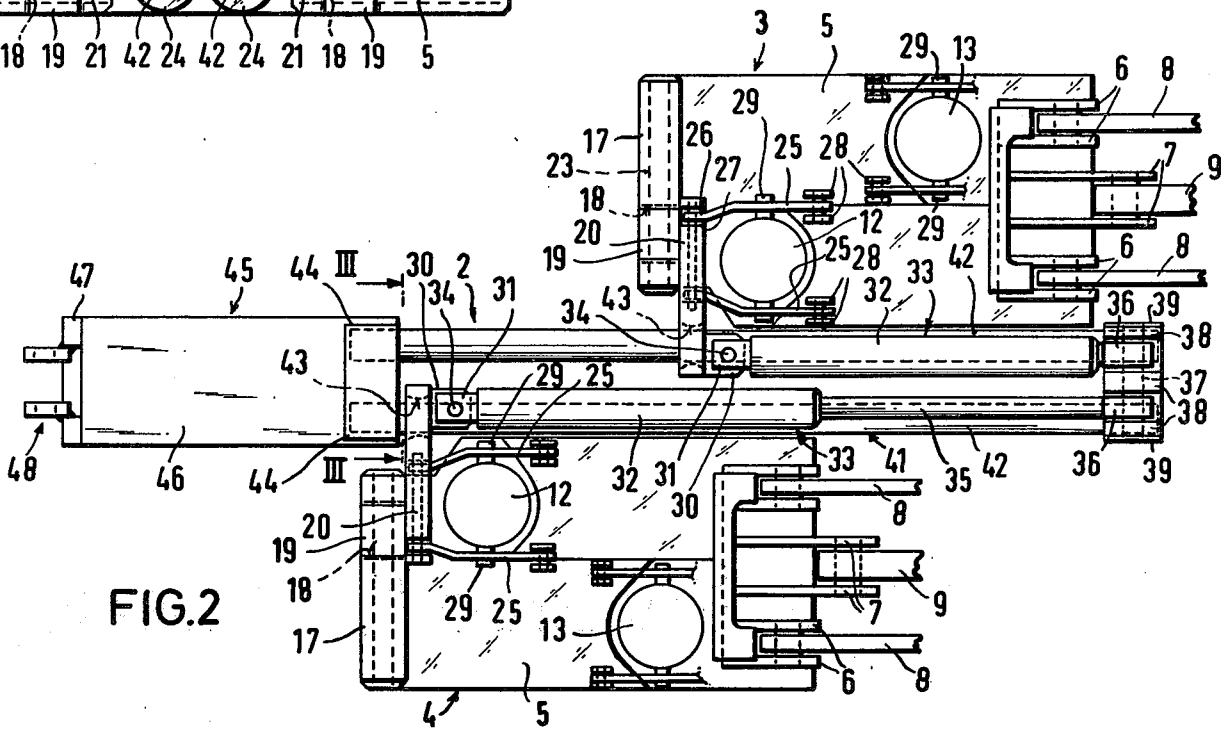
FIG. 2 is a top-plan view showing fllor engaging plate members of the mine roof support in accordance with the present invention, as well as displacing means located between the floor engaging plate members.

FIGS. 1 and 2 show a shield-shaped mine roof support which is identified in toto by reference numeral 1. The mine roof support 1 has two shield-shaped supporting units 3 and 4 located at opposite sides of intermediate displacing means 2.

Each of the supporting units 3 or 4 has a floor engaging plate member 5 provided with legs 6 and 7 at the rearward end section thereof. Links 8 and 9 are turnably connected with the legs 6 and 7 for turning about a horizontal axis. Upper end sections of the links are connected with the shield 10 which, in turn, is articulately connected with the rearward end section of a roof engaging cap 11.

Two cup-shaped depressions 12 and 13 are provided in each of the floor-engaging plate members 5 and are offset relative to one another in longitudinal direction. With respect to the vertical central longitudinal plane of each of the supporting units 3 or 4, the cup-shaped depression 12 of the mine face end section is located at that side of the plane at which it is adjacent to the intermediate displacing means 2, whereas the depression 13 of the rearward end section is spaced from the displacing means by being located at the other side of the plane. Telescopic props 14 and 15 are inserted in the cup-shaped depressions so that the prop 14 which is inserted in the front depression 12 is inclined backwardly and secures the rearward end section of the roof engaging cap 11, whereas the prop 15 which is inserted in the rearward-end depression 13 is inclined toward the not-shown mine face and supports the roof engaging cap 11 in a central longitudinal region thereof. The location and dimension of the links 8 and 9, as well as of the shield 10, permit the front edge 16 of the roof supporting cap 11 to be held at substantially identical spacing from the mine face, independently of the height to which the supporting units are extended.

Figure 3:
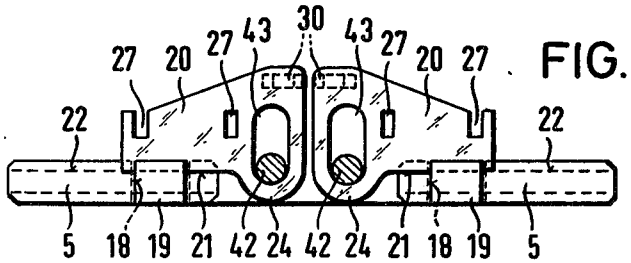
FIG. 3 is a front end view, partly sectioned, of mounting plates in accordance with the present invention, the section being on the line III—III of FIG. 2.

The mine face end sections 17 of the floor engaging plate members 5 are tubular. They are provided with recesses 18 in which tubular extensions 19 are inserted which form a part of the mounting plates 20 which are specifically shown in FIG. 3. Lower sides 21 of the mounting plates 20 lie on upper surfaces 22 of the floor engaging plate members 5 and are connected by their tubular extensions 19 with the tubular sections 17 of the latter by means of bolts 23. The mounting plates extend transversely to the longitudinal direction of the supporting units 3 and 4 and of the intermediate displacing means 2. They face toward one another and have extensions or enlargements 24 which are arranged adjacent to the floor engaging plate members and rest on the mine floor.

Further fixation of the mounting plates 20 is performed by angle-shaped braces 25. Lugs 26 of the braces 25 are inserted in respective recesses 27 of the mounting plates and fixed by transverse bolts. The other ends of the braces engage in consoles 28 arranged on the upper surfaces 22 of the floor engaging plate members 5 and are fixed by transverse bolts. The braces 25 fix the lower end sections of the props 14 so that they are turnable but cannot move out of the cup-shaped depressions 12. For this purpose, the props have lateral pins 29 which are overlapped by the braces 25. As can be seen from FIG. 1, the prop 15 located at the rearward end section of the floor engaging members 5 can be also fixed by such braces 25. The bending or angle points of the braces are located exactly above the lateral pins 29 of the props 14 and 15.

Figure 4:
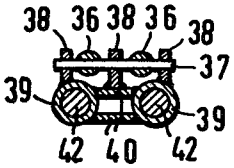
FIG. 4 is a vertical section taken on the line IV—IV of FIG. 1 and showing the connection of the guiding elements with cylinder-piston units of the mine roof support in accordance with the present invention.

Sections of the mounting plates 20 which face towards one another are provided with projections 30 extending toward the rearward end. The projections 30 are surrounded by forked heads 31 arranged at the end sections of the cylinders 32 of hydraulic cylinder-piston units 33. The connection of the forked heads 31 with the projections 30 is performed by vertical pivot bolts 34. Piston rod heads 36 of piston rods 35 are journalled on a common transverse bolt 37 which, as can be specifically seen from FIG. 4, extends through three vertical frame members 38. The frame members 38 are welded on two tubular members 39 which are rigidly connected with each other by transverse braces 40. Hydraulic conduits of the cylinder-piston units 33 as well as for the props 14 and 15, are not shown in the drawing for the sake of clarity.

The tubular members 39 located at the rearward end of the support form parts of guiding elements 41 located between the supporting units 3 and 4 in the region of the floor engaging plate members 5. The guiding elements 41 are, in turn, parts of the intermediate displacing means 2. The guiding elements include two guiding members (e.g. rods) 42 which are inserted in the tubular members 39 and secured thereto. At their mine face ends the guiding elements 42 extend through vertical elongated holes 43 of the mounting plates 20 so that they are movable both in axial direction and in vertical direction. The mine face ends of the guiding members 42 are secured to the tubular bodies 44 which are arranged at the mine-face side of an L-shaped and substantially trough-like extension 45. A bottom 46 of the trough-like extension closely conforms to the floor of the mine so that miners can relatively easily move even in extremely low mine galleries. A vertical arm 47 of the mine face end of the extension 45 is provided with coupling means 48 for connection with, e.g. the sidewall of the not-shown conveyor.

It will be understood that each of the elements described above, or two or more together, may also find a useful application in other types of constructions differing from the types described above.

While the invention has been illustrated and described as embodied in a walking mine roof support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A walking mine roof support, comprising roof engaging cap means; two supporting units each including a floor engaging plate member and a prop extending between a respective one of said plate members and said roof supporting cap means so as to support the latter, said floor engaging plate members being displaceable in a first direction toward a mine face and being spaced from one another in a second direction transverse to said first direction; and displacing means for displacing said floor engaging plate members in said first direction and including two guiding elements spaced from one another in said second direction, and two hydraulic cylinder-piston units operative independently of one another and each connecting one of said guiding elements with a respective one of said floor engaging plate members so as to displace the latter relative to but independently of another in said first direction.

2. The mine roof support as defined in claim 1; and further comprising an abutment element spaced from said two first-mentioned floor engaging plate members in said first direction toward the mine face, said guiding elements being connectable with said abutment element.

3. The mine roof support as defined in claim 1, wherein each of said floor engaging plate members has a mounting plate interchangeably mounted thereon, and each of said hydraulic cylinder-piston units has a mine face end section connected with a respective one of said mounting plates, so that the latter secures each one of said cylinder-piston units with a respective one of said floor engaging plate members.

4. The mine roof support as defined in claim 3, wherein each of said guiding elements extends through a respective one of said mounting plates and is movable relative to the latter in said first direction and in a vertical direction.

5. The mine roof support as defined in claim 3, wherein each of said floor engaging plate members has a mine face end portion, said mounting plate being mounted in said end portion of a respective one of said floor engaging plate members.

6. The mine roof support as defined in claim 5, wherein said mine face end portion of each of said floor engaging plate members is tubular and has a recess, each of said mounting plates being tubular and insertable into said recess of said tubular push end portion of said respective floor engaging plate member; and further comprising means for fixing said tubular portion of each of said floor engaging plate elements to said tubular portion of a respective one of said mounting plates.

7. The mine roof support as defined in claim 6, wherein said fixing means includes bolts.

8. The mine roof support as defined in claim 6, wherein said tubular portion of each of said floor engaging plate member has an outer radius and an inner radius which are substantially equal to an outer radius and an inner radius of said tubular portion of a respective one of said mounting plates.

9. The mine roof support as defined in claim 8, wherein each of said props has a lower section adjacent to a respective one of said floor engaging plate members, each of said mounting plates being operative for securing said lower section of one of said props to a respective one of said floor engaging plate member.

10. The mine roof support as defined in claim 9; and further comprising securing means arranged in each of said mounting frames and securing said lower section of one of said props to a respective one of said floor engaging plate members.

* * * * *